US007909216B2

(12) United States Patent
Costrop et al.

(10) Patent No.: US 7,909,216 B2
(45) Date of Patent: Mar. 22, 2011

(54) DEVICE AND METHOD TO FEED AND ALIGN A WEB WITH INCREASED WEB STABILITY FOR PRINTING

(75) Inventors: Dirk Costrop, Duffel (BE); Eduard Wouters, Schilde (BE); Tom Ramaekers, Mortsel (BE); William Waterschoot, Belsele (BE)

(73) Assignee: Punch Graphix International N.V., Lier (BE)

( * ) Notice: Subject to any disclaimer, the term of this patent is extended or adjusted under 35 U.S.C. 154(b) by 1095 days.

(21) Appl. No.: 10/580,238

(22) PCT Filed: Nov. 29, 2004

(86) PCT No.: PCT/BE2004/000168

§ 371 (c)(1),
(2), (4) Date: May 23, 2006

(87) PCT Pub. No.: WO2005/051818

PCT Pub. Date: Jun. 9, 2005

(65) Prior Publication Data

US 2007/0079712 A1 Apr. 12, 2007

(30) Foreign Application Priority Data

Nov. 28, 2003 (EP) ..... 03447277

(51) Int. Cl.

| | |
|---|---|
| ***B65H 20/00*** | (2006.01) |
| ***B65H 23/32*** | (2006.01) |
| ***B65H 23/10*** | (2006.01) |

(52) U.S. Cl. ..... 226/190; 226/196.1; 226/15

(58) Field of Classification Search ..... 226/2, 3, 226/15, 18, 19, 190, 194, 196.1; 242/566, 242/615.1, 615.21, 615.3

See application file for complete search history.

(56) References Cited

U.S. PATENT DOCUMENTS

| | | | | |
|---|---|---|---|---|
| 3,411,683 | A | 11/1968 | Bartles et al. | |
| 3,955,772 | A * | 5/1976 | Chisholm et al. | 242/564.5 |
| 4,750,660 | A * | 6/1988 | Kamimura | 242/615.3 |
| 5,455,668 | A | 10/1995 | De Bock et al. | |
| 5,685,471 | A | 11/1997 | Taubenberger | |
| 6,003,988 | A | 12/1999 | McCann et al. | |
| 6,634,534 | B2 | 10/2003 | Frodl et al. | |

FOREIGN PATENT DOCUMENTS

| | | |
|---|---|---|
| EP | 0 864 931 | 9/1998 |

* cited by examiner

*Primary Examiner* — William E Dondero
(74) *Attorney, Agent, or Firm* — Bacon & Thomas, PLLC

(57) ABSTRACT

A web alignment method and apparatus for a printing system that includes a friction drive, wherein the alignment device provides one or more of the following: a) a stable medium path with reduced web-walk, b) an alignment system that is not sensitive to the mechanical alignment of an upstream device such as a roll unwinder, c) an alignment system having a lower complexity and lower cost than active controlled systems, and d) an alignment system that is compatible with a wide range of media, ranging from lightweight papers (for example 60 gsm) to heavyweight stock (such as 300 gsm) including high weight high gloss coated grades. The alignment device includes an arrangement for supporting the web in an arcuate form between adjustable side guides.

18 Claims, 11 Drawing Sheets

DEVICE AND METHOD TO FEED AND ALIGN A WEB WITH INCREASED WEB STABILITY FOR PRINTING

The present invention relates to methods of printing and feeding continuous media or webs of sheet material and printers and feed controllers for continuous media. More particularly the present invention relates to an alignment method of continuous media for use with such a printer and an alignment system which can be attached to such a printer or integrated in such a printer.

TECHNICAL BACKGROUND

Multicolour printing systems that accumulate partial images on the final printed web of material require precise registration control. Partial images of the different primary colours need to be printed in registration with respect to each other as an additional requirement to the requirement of control of the position of the composite signature with respect to the web edges. This means that the control of the web has to be accurate over considerable distances. In paper post-processing technology, web guides are standard practice and common types generally operate based on active control units such as tilted frames as described, for example, in U.S. Pat. No. 3,411,683. Whereas such active steering systems are appropriate and very effective for adjusting the centreline of the web to a desired position, they are corrective control systems requiring an error to initiate a reaction. Therefore, the control units will continuously act and adjust the web position through adjustments of the tilted frame. An active control system will have a certain time constant for completing a correction. This time constant implies that the response of such a control system will have one or more fundamental frequencies, i.e. the position of the web will tend to vary cyclically. This means that the web is on average on the required centreline but limited amplitude drifts are inherently present in such systems and lead to low amplitude web walk or web meandering with frequency characteristics determined by the control system specifics. Moreover such systems are bulky and expensive and most effective at very high tension forces as common in rewinding applications. Therefore, there exists a need for a low cost passive alignment system for attachment to or integration in printer systems and other devices having a paper web in-feed.

Electrophotographic printing systems like the one described in U.S. Pat. No. 5,455,668 or an ink jet system of an architecture as described in U.S. Pat. No. 6,003,988 accumulate partial images over a distance along the web of over 1 meter and the temporal behaviour of the sideways web movement or "web-walk" as induced by an active steering system generally contribute to a significant extent to lateral registration errors between the colour separations. For high quality imaging it is generally desired that the contribution to lateral registration errors induced by web drift in between the transfer stations is better than 40 microns. This criterion is generally more severe than the requirement of registration with respect to the paper edges of the final printed pages.

High productivity roll fed printing systems benefit from large size unwinders that allow handling of large capacity print medium reels. Independent suppliers offer unwinder solutions and it is desirable to provide a flexible alignment solution to the printers that allows flexible connectivity to such unwinders without any cumbersome alignment procedure to align the different unwinders with the printing system. Hence, there exists a need for an alignment system that is insensitive with respect to mechanical misalignment of an external aligner, e.g. for a printing system.

A problem with thin paper webs is local Euler buckling. Euler buckling is buckling of a thin column into a bow-like or wave-like shape when placed under compression. The critical load which can be applied before buckling is initiated varies approximately as:

$$P_{cr} = \frac{\pi^2 EI}{L^2}$$

wherein E is Young's modulus and I is the moment of inertia. For a quadratic cross-section the value of I is proportional to the cube of the thickness—hence the danger of mechanical buckling, edge curling or creasing of the paper web with a small thickness when a control device tries to push on one edge of the paper. Attempts to straighten a paper web will generally place one part of the web under tension and another under compression. Paper is not very extensible so movement has to be absorbed in compression. The most likely compression mode is buckling which results in edge folding or creasing within the bulk of the material. Another problem can occur if the alignment consists of many rollers over which the paper must pass. Due to the frictional forces between the paper and the rollers it becomes increasing difficult to align the web by sliding the paper sideways over the roller. This problem gets worse as the tension increases in the web.

A passive alignment system, which makes use of some of the recommendations given above and addresses a part of the desired features, is disclosed in U.S. Pat. No. 5,685,471. This known alignment system uses forcible guidance on one edge in an alignment zone where the paper tension is reduced with respect to the paper tension as exerted by the drive system of the printer. A slanted friction roller ensures the forced contact to the single aligning edge. It was found that such a solution is not appropriate in printing systems that need to address a broad range of printing media including high gloss substrates of high weight per unit area. Forcible alignment by such a slanted roller is especially questionable as a solution when the print media have a width exceeding 250 mm. Localised friction contacts are found to damage the medium surface by locally degrading the gloss, especially for higher medium weights that require higher forces for assuring forcible contact to the single side-guide.

There remains a need for an alignment system for continuous media with reduced webwalk and which is convenient and economical.

SUMMARY OF THE INVENTION

It is an object of the present invention to provide an alignment method for use with a printer or other device and an alignment system attached to or integrated in such a printer or other device, which solves some of the above problems, especially to provide an economic alignment method and apparatus which reduces web-walking.

In one aspect the present invention provides printing system or other system comprising a friction drive that provides one or more of the following:

a) a stable medium path with reduced web-walk, b) an alignment system that is not sensitive to the mechanical alignment of an upstream device such as a roll unwinder, c) an alignment system having a lower complexity and lower cost than active controlled systems, and d) an alignment system that is compatible with a wide range of media, ranging from lightweight papers (for example 60 gsm) to heavyweight stock (such as 300 gsm) including high weight high gloss coated grades.

The aforementioned objects are achieved by the present invention, which in an embodiment, provides a web alignment device to align a web of continuous print medium or other medium having two outer edges and originating from an upstream device to a stable lateral position with respect to a printing system for further printing on said continuous web or with respect to another system which performs operations on a web and the printing or other system having a friction drive downstream of the web alignment device. The web alignment device can be attached to or integrated into a printer. The alignment device which is preferably a passive alignment device comprises: means for defining an entry position of a web. The entry means is preferably a mechanical means contacting the web in a sliding or rolling mode. The web is preferably supplied as a nearly tension free loop, e.g. it may hang in a catenary between two pay off positions 0.5 to 1.5 meters or 2 meters apart. Between these two pay off positions the web is not pulled tight but hangs under its own weight. The tension in the web can be 1.6 N/m or less for a 80 gsm web, e.g. paper; or 6 N/m or less for a 300 gsm web, e.g. paper, from an upstream device to the alignment device or more generally a tension of $2\times10^{-2}$ N/m per gram per square meter of web material or less.

The alignment device also includes braking means to reduce the tension-force per unit of medium width at the end of the alignment zone compared to the tension force per unit of medium width downstream as exerted by the friction drive of the printing system by a factor of at least 3, and means located upstream of said braking means and defining a partially curved first movement trajectory including areas where the print medium slides in friction contact with a curved surface of said means defining a partially curved first movement trajectory, the sliding zone of the first trajectory extending over a finite length L1 satisfying the relation $$L1>\max(50\text{ mm},P/4)$$

where P corresponds to the width of the web, e.g. the print medium width, and adjustable lateral guiding means that can be adjusted to contact at either of the two outer edges or at both outer edges of the web, e.g. said print medium, thus limiting the lateral movement dimension available for the web, e.g. print medium in two opposing directions, the adjustable guiding means extending over a finite second movement trajectory of the web, e.g. print medium, wherein the second trajectory with side guides on both sides of the web extends in the upstream direction to further than said means for defining the entry position and comprises at least a part of the first trajectory where the web, e.g. print medium is in sliding contact with said stationary means defining said partially curved first trajectory. The length (L2) of simultaneous side-guiding and support for sliding satisfying the relationship: L2>⅔*max(50 mm, P/4). It is preferred if L1>MAX (100 MM, P/2). It is also preferred if L2>⅔*MAX(100 MM, P/2).

The adjustable guiding means are present on both sides of the web and can be contacting a single or each of two side guides along the trajectory if the guides are adjusted width a separation that exceeds the medium width of the web. Because of fluctuations in the unwinding the web may change over from contacting the left guide to contacting the right guide and vice-versa. If the guide-separation is adjusted to coincide with the medium width, simultaneous contact with both guides along segments of the supported an side-guided trajectory is achieved. Hence in one aspect of the present invention two side guides are employed with either of them contacting or both contacting at the same time.

The means located upstream of said braking means and defining a partially curved first movement trajectory may include one or more stationary elements, e.g. curved shells or fixed rollers.

The present invention also provides a method of aligning a continuous web of material originating from an upstream device to a stable lateral position with respect to a web based system for further printing or processing on said continuous web, said system comprising a friction drive, the method comprising:

guiding a web medium at a reduced medium-tension compared to the downstream tension imposed by a friction drive of the system in a sliding contact in a sliding zone along a means defining a first curved trajectory in the web travel direction, the sliding zone of the first curved trajectory extending over a finite length L1 satisfying the relation $$L1>\max(50\text{ mm},P/4)$$

where P corresponds to the width of the print medium, centering said print medium by guiding both lateral edges in the lateral direction by adjustable side-guides along a second trajectory that comprises at least a part of the first trajectory where the print medium is in sliding contact with said means defining said curved trajectory, the length (L2) of the second trajectory satisfying the relationship:

$$L2>\tfrac{2}{3}*\max(50\text{ mm},P/4).$$

Web tension is preferably controlled such that the print medium forms a nearly tension free loop prior to entering into the sliding contact.

The invention will now be described with reference to the following drawings.

BRIEF DESCRIPTION OF THE DRAWINGS

FIG. 9 shows the minimum position and FIG. 10 shows the maximum extension position.

DESCRIPTION OF THE ILLUSTRATIVE EMBODIMENTS

Figure 1A:
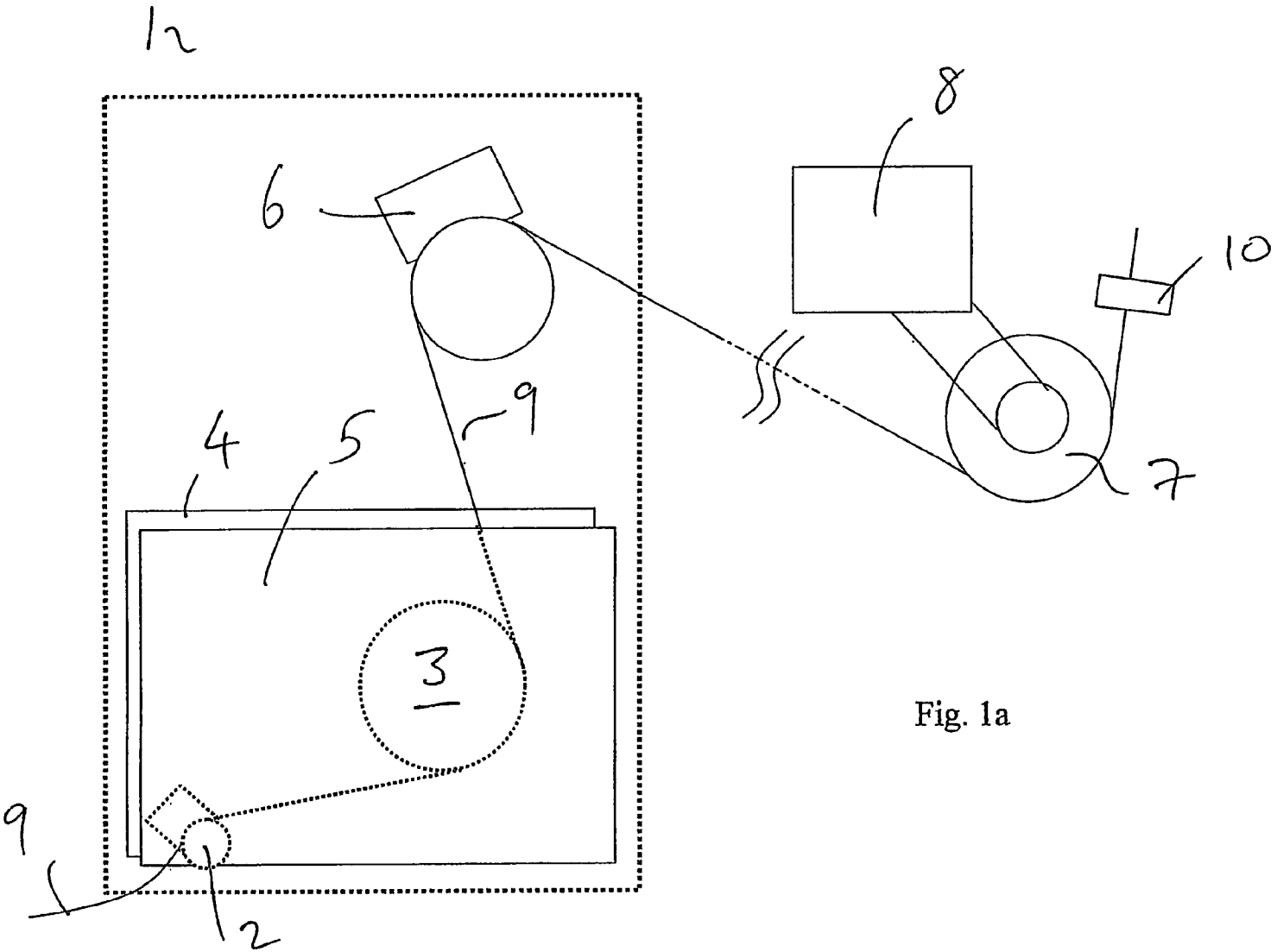
FIG. 1*a* shows a schematic view of the path of a continuous web through an alignment device according to a first embodiment of the current invention.

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. Where the term "comprising" is used in the present description and claims, it does not exclude other elements or steps. Where an indefinite or definite article is used when referring to a singular noun e.g. "a" or "an", "the", this includes a plural of that noun unless something else is specifically stated.

Furthermore, the terms first, second and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

Moreover, the terms top, bottom, over, under and the like in the description and the claims are used for descriptive purposes and not necessarily for describing relative positions. It is to be understood that the terms so used are interchangeable under appropriate circumstances and that the embodiments of the invention described herein are capable of operation in other orientations than described or illustrated herein.

FIGS. 1*a* and *b* show schematic diagrams with a web path in a web alignment system 1 according to an embodiment of the present invention. The web alignment system in all embodiments is preferably a passive alignment system, that is it does not need to include a proximity sensor to determine the lateral position of the web and an actuator to change this location based on an error signal from the proximity sensor. A drive system 7,8 of a system which performs operations on a continuous, flexible web of material, e.g. a web based printing system, exerts a pulling tension on the web 9 in a range appropriate for the relevant process, e.g. a printing process. The drive system optionally includes a friction roller system 7 and accompanying motorized drive system 8. Such web based systems, for example printing systems, such as described in U.S. Pat. No. 5,455,668, can work with a combination of driven rolls operated in speed controlled mode and torque controlled mode. In printing systems a tension force per unit of medium width ranging from 100 N/m to 1000 N/m is typically imposed on the web 9 as can be measured at the input of the print engine 10.

In embodiments of the present invention a brake system 6 is used to reduce the tension force per unit of medium width preferably by a factor of at least 3, more preferable a factor of 10 when the tension in web 9 as developed by the drive system 7, 8 and the tension in the web 9 in the alignment device 1. Whereas the paper tension force in the print system depends on the specifics of the print system that are unrelated to the present invention, it has been observed that a tension force per unit of medium width at the exit of the alignment device 1 of between 6 N/m and 50 N/m is preferable in the alignment area upstream of the brake 6.

Brake systems 6, can comprise any suitable braking device such as a friction brake, an electromagnetic or a vacuum brake, for instance as proposed in U.S. Pat. No. 5,685,471. For example, simple friction pads that are pressed at a position where the web is supported from the opposite side by a drum which can be supported on bearings for rotation, generally provide a low cost means to impose the required tangential braking force by friction. The friction pads may be biased against the web material 9, e.g. by suitably dimensioned springs. Materials for the friction pads can be selected from a wide range of available felt materials such as wool and its felt density etc. can be selected to maximize uniformity and softness in order to reduce the possibility of scratching sensitive glossy print media which may comprise delicate coatings while minimizing the wear and possible dust formation. Alternative pressure pads can consist of metal blades that can be optionally provided with a coating, especially a polymer coating or a polymer blade such as polyurethane or polytetrafluorethylene (PTFE). The contact area between the pad and the media is preferable greater than 20 cm squared in order to spread the braking forces over a significant area of the web print media. For example, contact areas exceeding 100 cm squared in the case of a soft extended felt based on low-density wool have been tested successfully. Brakes acting on the shaft of the rotatably mounted support drum can be selected as a replacement or addition to a friction brake to minimize the likelihood of damage such as scratches to the surface of the web material, e.g. a sensitive, coated print medium.

Figure 1B:
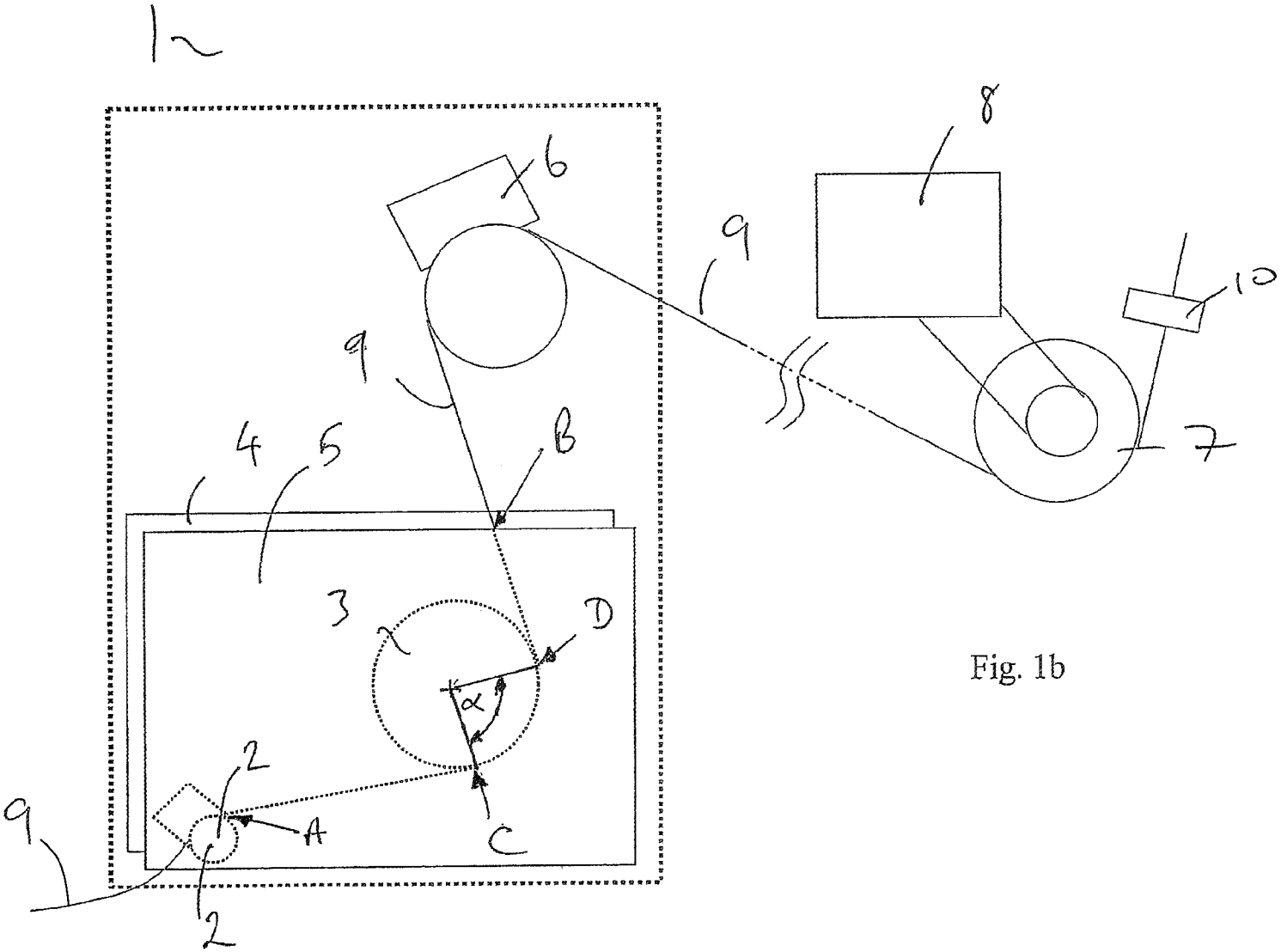
FIG. 1*b* shows the same schematic view indicating notations for delimiting segments of the print medium trajectory.

At least one arcuate path is provided, defined, for example, by a curved shell or fixed roller or backwards rotating roller 3 or similar over which the web material 9 is constrained to slide. Relative movement between the web material 9 and the curved shell, fixed roller or backwards rotating roller 3 is an important aspect of the present invention. Such a curved path can be frictional force inducing by relative sliding. The curved shell can be composed of a single curved element or may comprise a plurality of spaced-apart elements, e.g. rods, or an undulating surface over which the web material 9 moves. Two laterally adjustable side guides 4,5 further determine the medium path of the print medium 9 in the alignment system. The direction of adjustment of the side guides 4, 5 is in a direction perpendicular to the movement direction of the web 9, i.e. to determine the lateral position of the web 9. The purpose of components which define the arcuate path is to simultaneously guide the web around an arcuate path and to support the web material. Also an increase of the tension force in the web can be provided to a degree. Referring to FIG. 1*b*, the arcuate path may be defined by a supported trajectory length between C and D to a side guided length between A and B in which the side guides 4, 5 control the position of the web 9. The arcuate path is intended to generate a partly cylindrical web form—that is the arcuate form of the web material in its curved state extends across the width of the web material 9 in this zone and is constrained by the adjustable side guides 4, 5. This arcuate, partly cylindrical form provides more lateral stability to the web material than a flat web and reduces the possibility of edge buckling.

Optionally an entry position of a web is more precisely defined by entry position defining mechanical means 2, which can consist of low friction rollers or at least one fixed axis with optionally an additional friction pad. The additional friction position defining means 2 allow to define a certain minimum tension force per unit of medium width at the entry of the alignment system, that exceeds the tension force of the media in the nearly free hanging loop as provided by a device upstream, such as an unwinding device. Preferably, the guides 4, 5 extend in the upstream direction of the web material to or beyond the entry position means 2. The guides may further include an entry flare to assist in guiding the web material into a narrow section between the parallely arranged guides 4, 5.

The web form upstream of the entry position defining means may be a catenary whereby the web tension is determined by the tension needed to support the weight of the freely hanging loop. A distance is provided between an unwinder and the alignment device and the web hangs freely across this distance, e.g. 0.5 m to 1.5 m. The material entering at the entry point is nearly tension free which means preferably that the tension is less than 0.8 N for a 0.5 m wide web or less than 1.6 N/m for 80 gsm media, i.e. less than $2\times10^{-2}$ N/m width of web per gram per square meter of web material. This scales with medium weight so that the tension should be less than 3 N for a 150 gsm media or less than 6 N/m for 300 gsm media.

Figure 3:
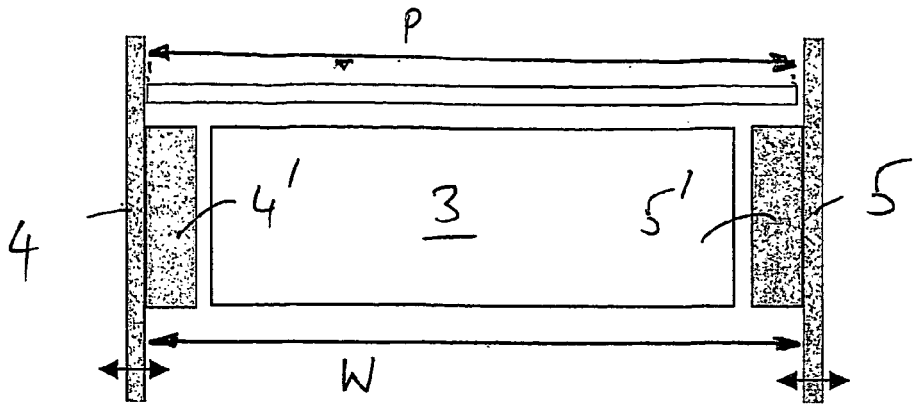
FIG. 3 shows a detailed section corresponding to FIG. 2. A preferred adjustment is such that the side-guides spacing W is slightly less than the width P of the print medium web 9.
Figure 2:
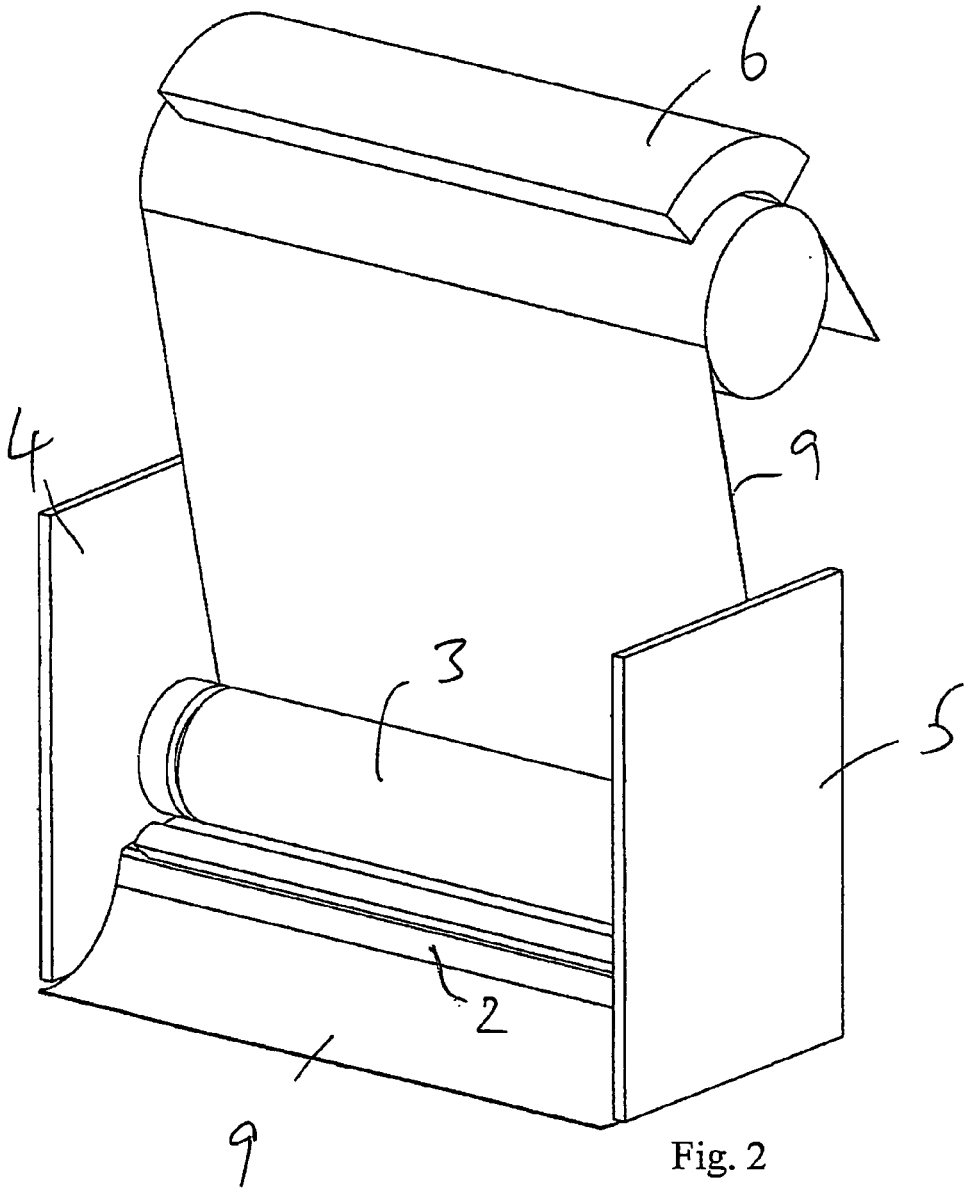
FIG. 2 shows a view of said paper path emphasizing a preferred implementation in which end segments of the fixed rollers are integrated in the adjustable flanges acting as side-guides

FIGS. 2 and 3 show views of an alignment system 1 according to a further embodiment of the present invention in which the adjustable side guides 4, 5 are formed as flanges 4', 5' that are integrated with the outer segments of a composite roller surface (best seen in FIG. 3). Such adjustable side guides 4, 5 unambiguously define the edges of the web and limit the range available for sideways movement of the print media. Adjustable guides 4, 5 that move compared to a curved shell with a lateral extent exceeding the width of the media, solve the problem of thin media being caught in any gaps between the adjustable guide 4, 5 and the shell.

Extruded surfaces with corrugated profiles can be used for the matching side guides as discussed in U.S. application US2002/0179671 and are expected to be capable of reducing this problem as well and can be incorporated in embodiments according to the present invention. Such corrugated profiles, however, are expected to contain irregularities causing localized friction that could damage sensitive glossy media, especially if those glossy media would have a relatively high weight such as exceeding 120 gram per square meter.

Figure 4:
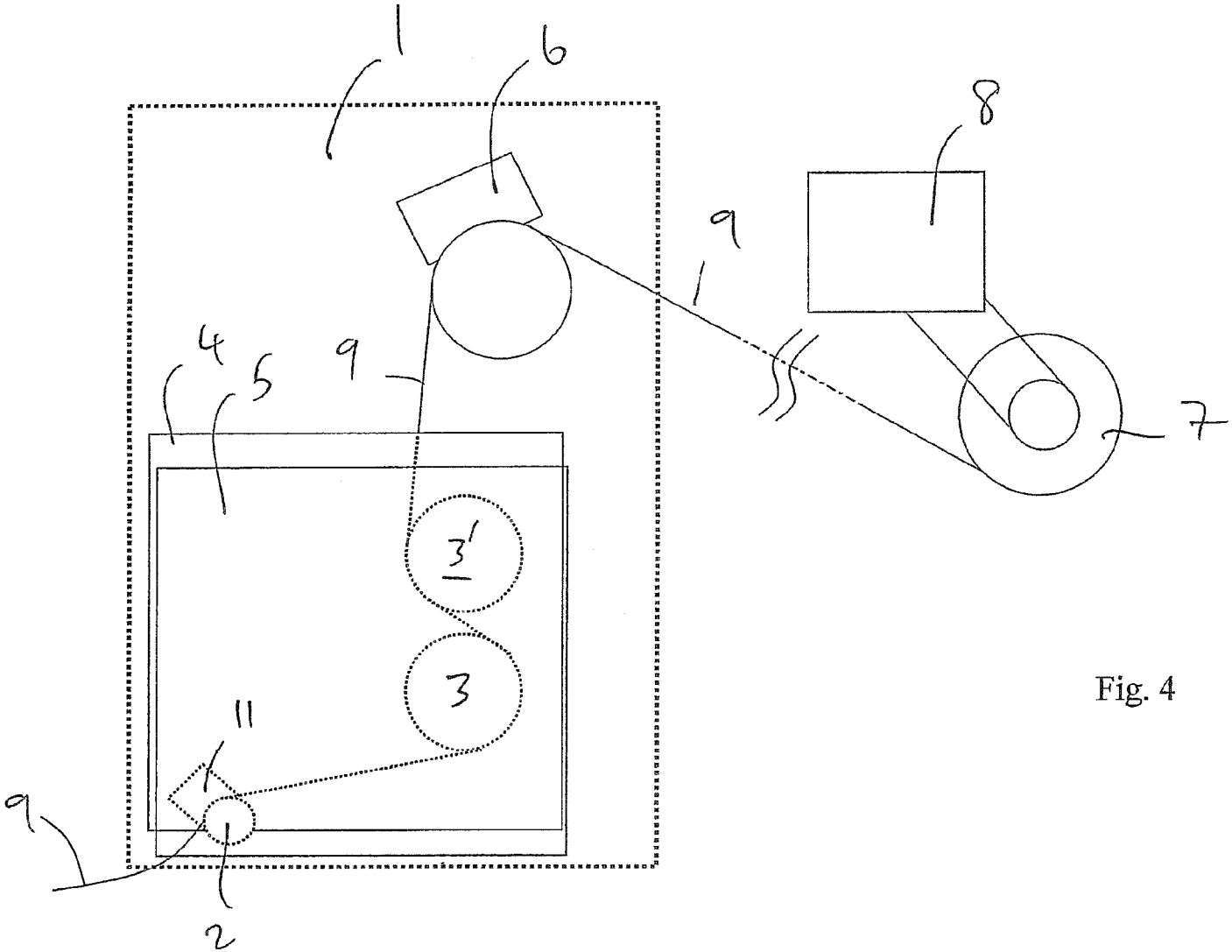
FIG. 4 shows an alternate preferred embodiment of the present invention comprising two fixed rolls resulting in consecutive bending of the web in both directions.
Figure 5:
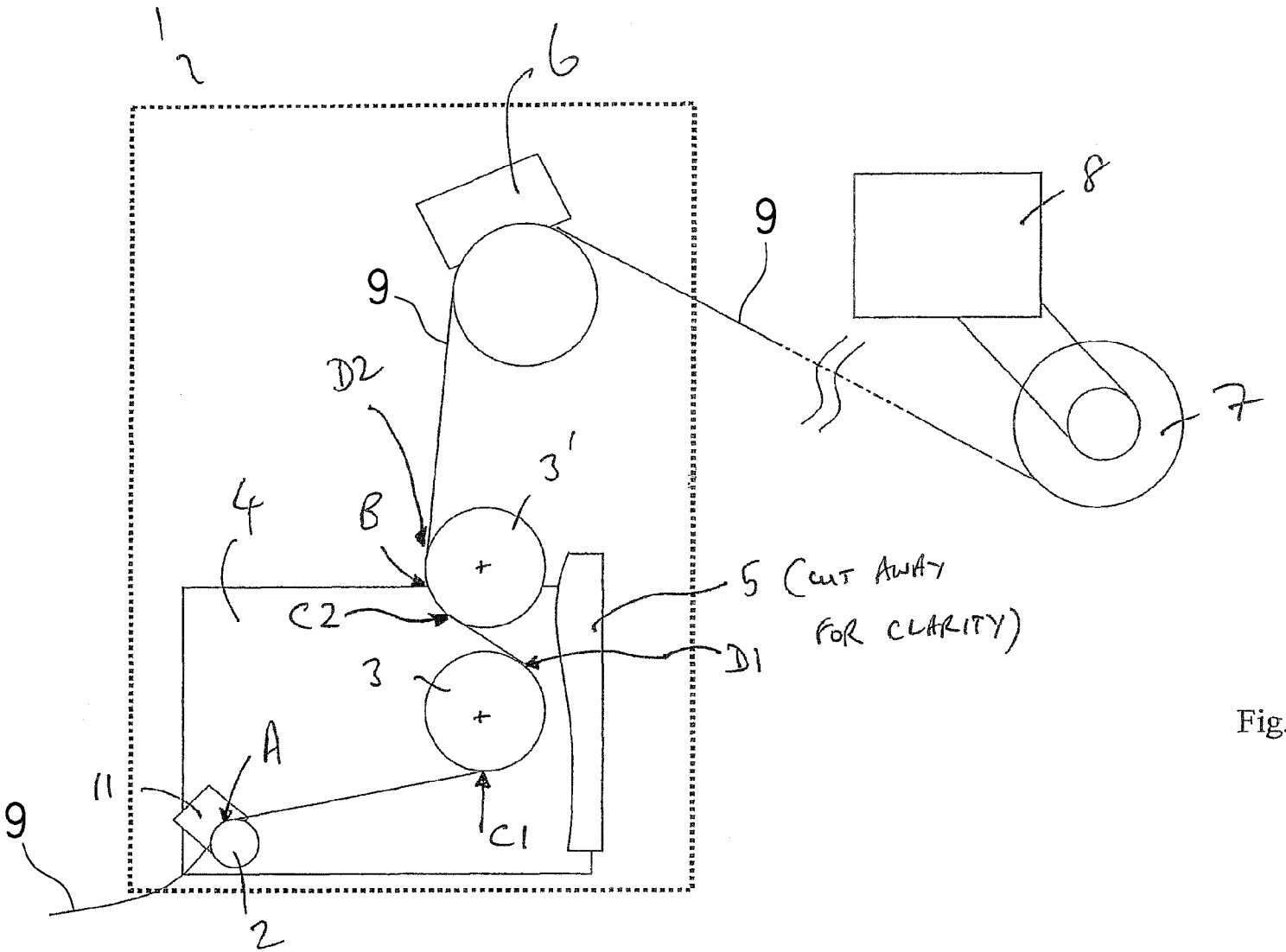
FIG. 5 shows the alternate preferred embodiment as in FIG. 4 illustrating the concept of composite curved print medium trajectories and partial overlap.
Figure 6:
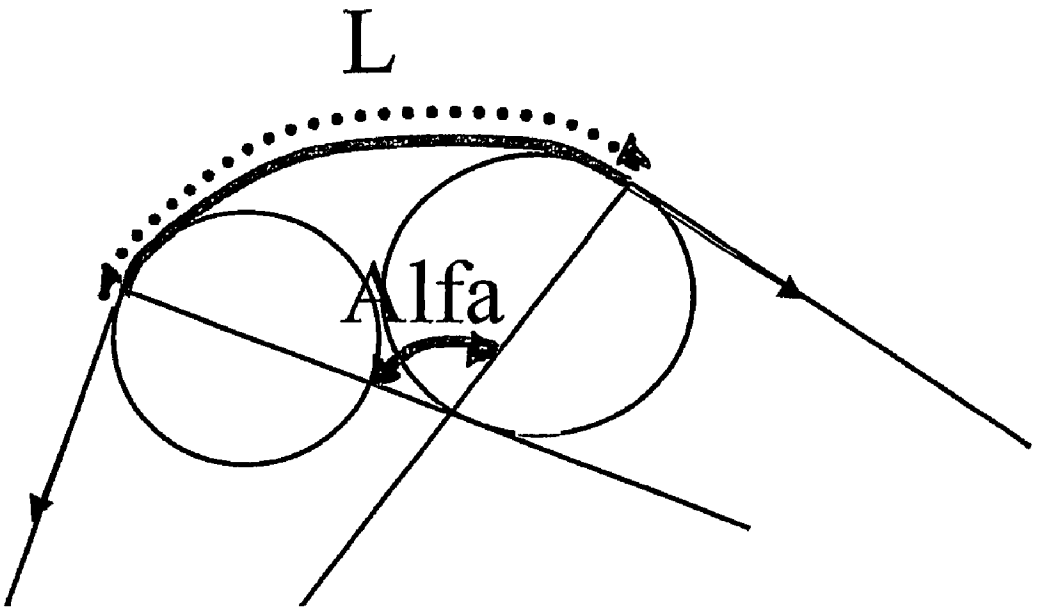
FIG. 6 shows a detail of the arcuate path of a web material in an alignment device according to an embodiment of the present invention.

Referring now to FIGS. 4 and 5, a side view of an alignment device in accordance with another embodiment of the present invention is shown and to FIG. 6, a portion of an arcuate path of web 9 is shown in side view. This arcuate path extends over a distance L. Along this distance L the web material 9 is supported at at least one position. Due to the arcuate form the web movement direction changes by an angle alpha. If there are several segments to the arcuate path, the length L may be made up of several sub-lengths and the angle alfa may be made up of several subangles. For each segment a curved trajectory is provided for the medium is guided in a curved supported mode over a distance L and through an angle alpha. The arcuate form of the media and the support typically coincide more or less. The "arcuate" form of the "curved" support can be specified in terms of a sequence of or gradient of local radii of curvature.

The wrap angle alfa is defined by normal lines to the web material surface at the positions where the contact ends. Alfa being non-zero results in a component of the tension force in the medium being normal to the "support surface". In this manner the paper experiences a gentle force towards the support and buckles or creases in the web in the lateral direction (these would be normal with an unsupported paper) are relaxed and spread out as the medium position is confined within the alignment device. As the medium gets flattened it will fully occupy the space between the adjustable side guides.

The side guides 4, 5 according to the present invention preferably extend over a significant length of the paper trajectory and it has been found that the part of the trajectory provided with the adjustable side guides should at least partially overlap with the trajectory of the web that has a finite curvature. In FIG. 1*b* an example of a medium trajectory segment with finite curvature is shown as a segment CD where the curvature results from a wrap over a curved surface through an angle alpha, while the medium trajectory over which the laterally adjustable side-guiding extend is denoted by the partially curved segment AB. It was found that best results are obtained when the medium trajectory over which the laterally adjustable side-guiding extend overlaps at least partially with one or more of those finite curvature segments CD in which the media is forced to slide over a fixed surface or shell.

FIG. 4 shows a preferred embodiment in which the curved trajectory is realized by means of 2 fixed rollers 3, 3', wherein the end segments of the rollers 3, 3' are optionally integrated with the adjustable side guides 4, 5. In this embodiment the trajectory in which the print media slides along curved surfaces is a composite trajectory consisting of sections C1-D1 and C2-D2 as indicated in FIG. 5. The total sliding contact length L now corresponds to the sum of the lengths C1-D1 and C2-D2. Hence, in FIG. 5 the length L which is supported, i.e. $L_{(supported)}$ is given by the distance C1 to D1 plus C2 to D2. The length of web material which is guided by the adjustable side guides is $L_{(sideguided)}$ determined by the distance A to B. The distance over which the web material is both supported and side guided, i.e. $L_{(supported\ and\ side\text{-}guided)}$ is determined by the distance C1 to D1 plus C2 to B.

It has been determined by experiment that the trajectory length L when the web material is guided by the adjustable plates independent of its shape or whether it is supported should be: $L_{side\ guided}$>max(50 mm, medium width/4). The preferred length L when the web is supported and sideguided, i.e. $L_{(supported\ and\ side\text{-}guided)}$ is greater than ⅔*max(50 mm, medium width/4). Even more preferred: is that $L_{(side\ guided)}$ is greater than max(100 mm, medium width/2) and thatq $L_{(supported\ and\ sideguided)}$ is greater than ⅔*max(100 mm, medium width/2).

It is preferred that the web material is guided on both sides from or before the entry position means 2 and the length L is limited to that part of the (composite) support confined within the extension of the adjustable side-guides.

This mechanism works well if certain conditions are met in terms of bounds on the radii of curvature. If locally a radius of curvature of the support is too small—stiffer media will not be able to remain in contact with the support at the moderate medium tensions that are to be used. If the radius of curvature is too large, for instance if the support evolves from a curved shape into a substantially flat shape, then this substantially flat part of the segment would not significantly contribute to the alignment support.

A "curved surface" should preferably exclude parts where the local radius of curvature gets bigger than a limiting value, optionally resulting in a separate curved segment as the radius of curvature becomes less that the upper limit (all other conditions being met). Similarly, the curved surface should preferably exclude parts where the local radius of curvature gets smaller than a limiting value. If the curved support would have an undulating surface this can be considered as an arcuate shape with several flexing points. Such a support can be a corrugated extrusion as described in U.S. application US2002/0179671. In this case, the medium will follow the convex hull, and the convex hull will be considered in terms of the definitions above.

Suitable radii of curvature of parts of the web movement trajectory which contribute to the arcuate path are given in Table 1. Any radius of curvature which is too small, e.g. the radius of the axle or shaft at the entry position (2), is not considered to contribute to contact length.

TABLE 1

| Medium weight | Min R | Max R | More preferred Min R | More preferred Max R |
|---|---|---|---|---|
| 80 gsm | 6.4 mm | 300 mm | 12.8 mm | 200 mm |
| 300 gsm | 24 mm | 400 mm | 48 mm | 300 mm |
| 400 gsm | 32 mm | 500 mm | 64 mm | 400 mm |
| Independent of weight | 24 mm | 300 mm | 48 mm | 200 mm |

A suitable radius for general working has been found to be 40 mm which is a compromise of the above values. It has been found that the combined action of pulling the web in a curved paper path over one or more fixed or backward rotating surfaces, preferably of a fixed roller or curved shell, with lateral guiding on both sides followed by the increased pull after the brake 6 has an unexpectedly dramatic effect on the positional stability of the web as measured with an positional edge sensor 10 just after a drive roller.

It was moreover found that good results with web drift fluctuations being reduced to values of less than 50 microns could be maintained for a range of media when the distance between side guides 4 and 5 where adjusted to a value W as indicated in FIG. 3 which is not greater than the media width (P)+1 mm and not less than the medium width (P)−2 mm, while it was found that for lower medium weight print media it was preferred that the value W would be set smaller than the medium width by 0.5 to 1 mm.

It was moreover found that the presence of the two side guides solves issues that can originate from print medium reels that are slightly irregularly wound. Such reels have a tendency to drift in one lateral direction as can be verified by mounting the reel upside-down—reversing the direction of walk. Systems with a single side guide would have to provide sufficient margin in the lateral force to overcome this tendency.

A surprising finding is that after selection of the proposed range for the radius of curvature of the curved shell or fixed rollers 3 and the length of the contact area, the balance between reaction forces at the side guides and forces needed for minor adjustments of the print medium sliding on the fixed surfaces were stable over a remarkably large range of print media in terms of medium weight and medium stiffness.

It should be noted that the optional integration of end segments with the adjustable side guides is not a requirement of the present invention. Moreover it was found that additional flexing of the media, by for instance an adjustable bar 11 that extends over a substantial part of the print medium width as shown in FIG. 5 as part of the entry means 2 can be beneficial to avoid wrinkles that could form for thin media. This bar 11 may be placed at other positions within the alignment device. These wrinkles might develop a tendency to form at the unsupported gap between a fixed central segment and the end-segments that are movable with the adjustable side-guides.

In order to reduce the likelihood for damage to such media, it is important to keep the tension force per unit of medium in the suggested range. The medium trajectory is curved along a fixed sliding surface 3, resulting in a normal component pressing the media against the surface for frictional sliding.

Whereas the fixed shafts, bars, rollers or curved shells can comprise common materials such as aluminium alloys or various steels, it is found that a low friction, wear resistant coating such as a nickel coating or a chrome coat can be applied as well as polymer based wear resistant coatings that may include anti-static components and additives to control roughness to reduce friction. Such materials selected for low friction and wear resistance are beneficial in order to reduce the likelihood of damaging the surfaces of the most sensitive media.

After being aligned by means of the adjustable guides 4,5 and the fixed rolls or shells 3 at a reduced tension force per unit of medium, the print media passes the brake 6 separating the alignment section 1 from the downstream path towards the print engine 10 where the tension force per unit of medium is increased substantially. Increased tension at a given separation between the brake 6 and the drive unit 7 adds to the stability of the position of the running web. It should be noted that additional rollers of drums, supported on bearings for rotation, can be introduced between the brake 6 and the drive 7 for different reasons such as architectural reasons or to increase the length of the web between 6 and 7 without increasing the footprint of the printing system, without departing from the scope of the present invention.

Figure 7:
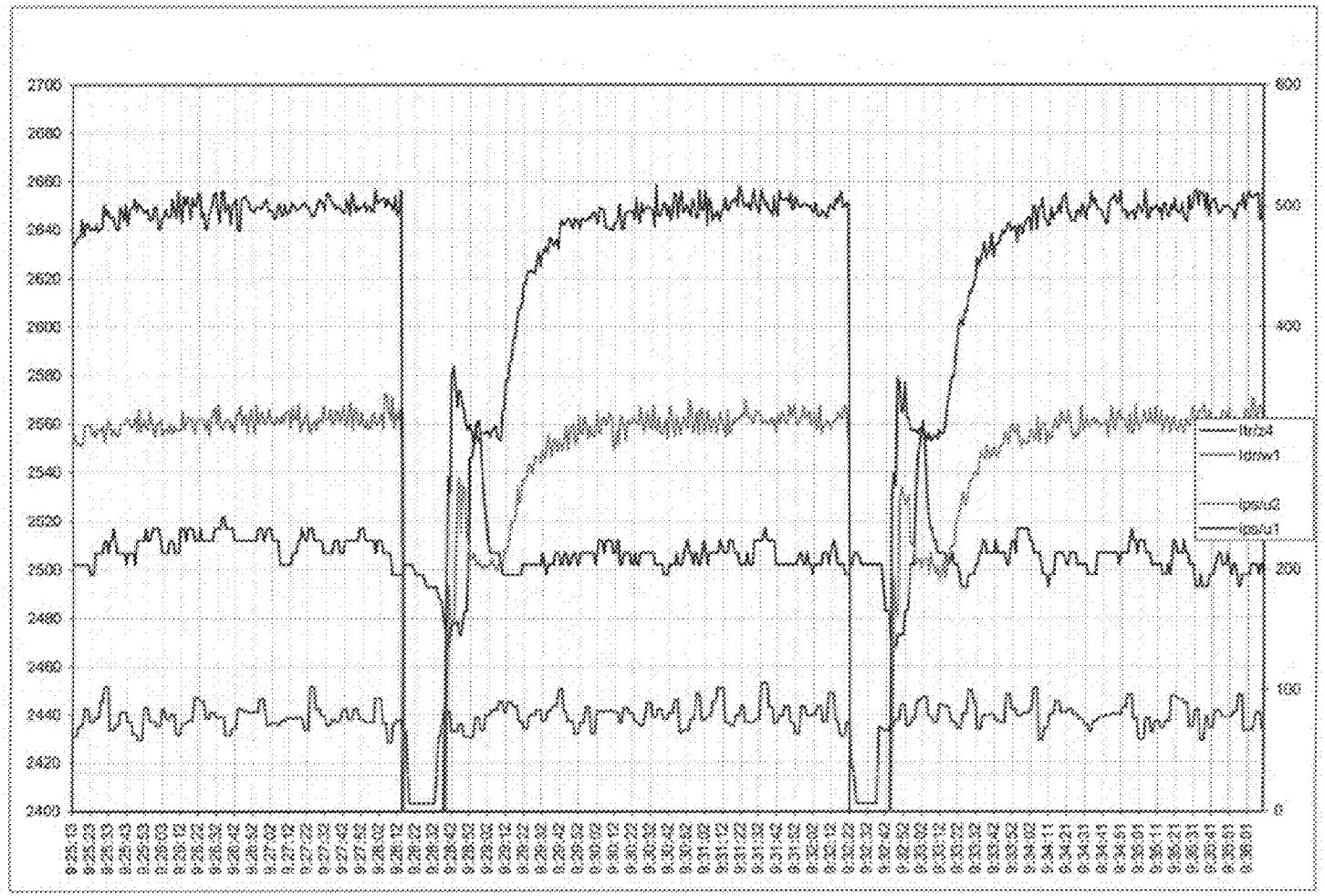
FIG. 7 shows results of alignment trials in accordance with the present invention.
Figure 8:
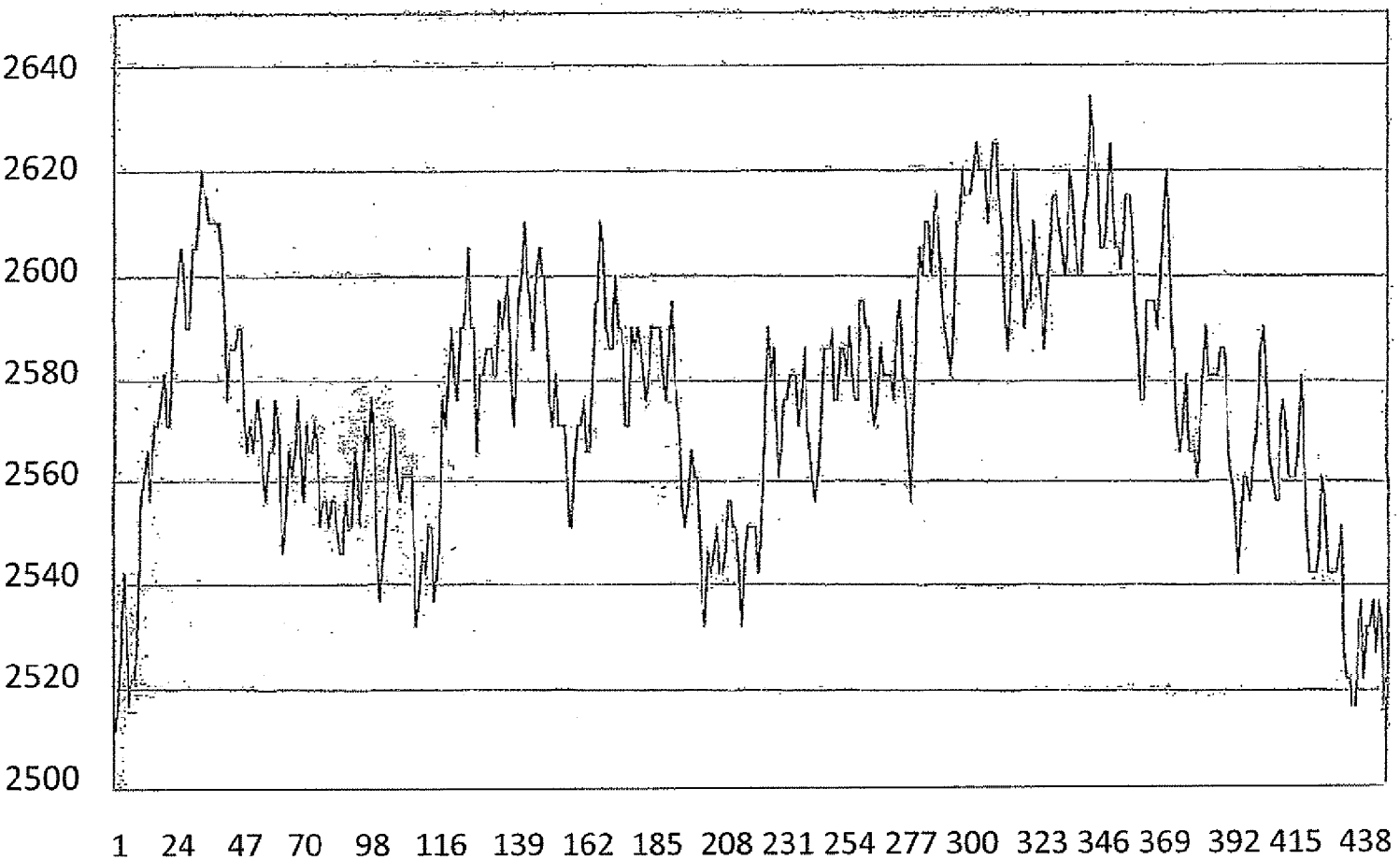
Fig. 8 PRIOR ART
FIG. 8 shows results of alignment trials in accordance with a conventional active control system.

The alignment system described above can be realised as a low cost system that is operator adjustable without the necessity for automated adjustment. A comparison between a system in accordance with the present invention and an active web control system is shown in FIGS. 7 and 8. In FIG. 8 the active control system shows a typical oscillatory variance in the web position. The X axis is a time axis in seconds. The Y axis gives the lateral displacement whereby 100 units represents 240 micron. The lateral positional variation of the web is of the order of 100 units, i.e. plus or minus 120 micron. FIG. 7 shows a similar system controlled by an alignment device of the present invention. The X axis is a time axis in hours.minutes.seconds. The Y axis gives the lateral displacement whereby 100 units represents 240 micron. Each curve represents a different trial. The lateral positional variation is typically about 20 units maximum, i.e. about plus or minus 24 micron. Hence, a system in accordance with the present invention reduces web walk to a low level, e.g. web control of +/−25 or +/−50 microns compared with +/−120 microns for the conventional system.

Figure 9:
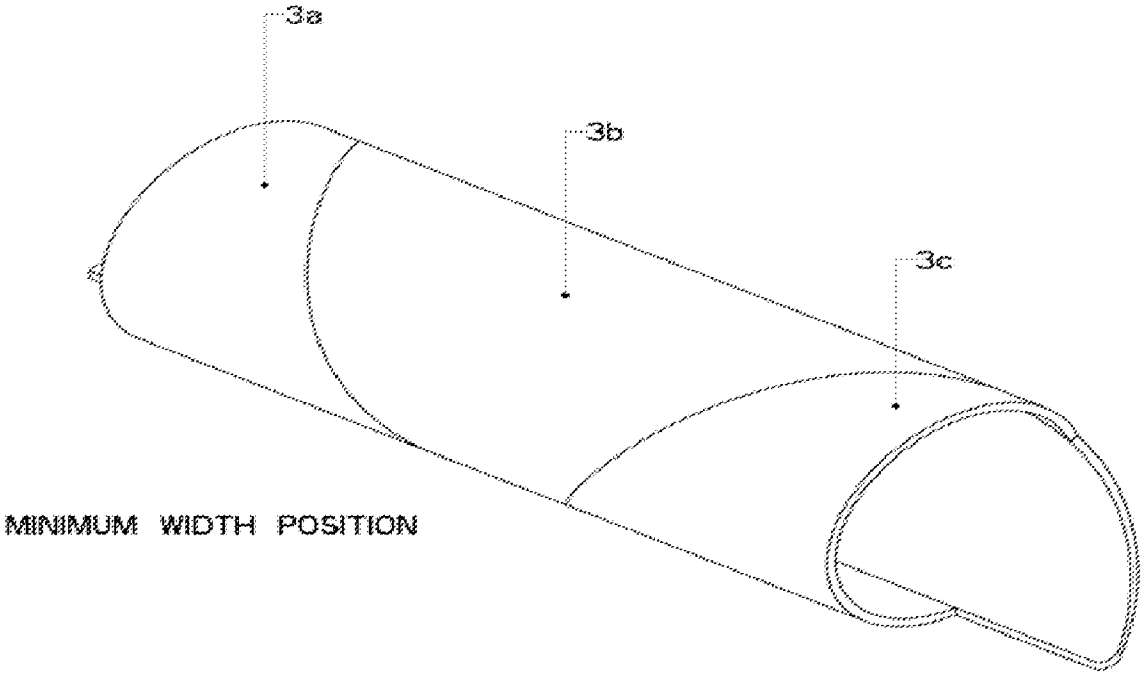
FIGS. 9 and 10 show a device for adjusting the length of a tubular shell for use with the present invention.
Figure 10:
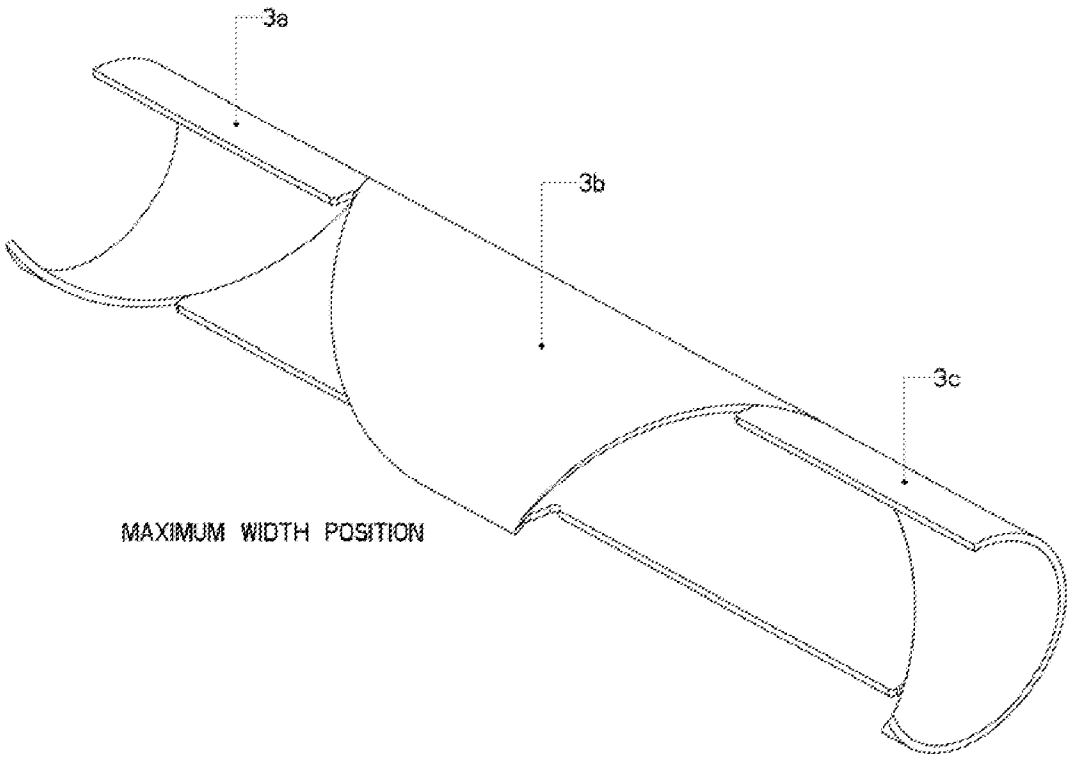
Figure 11:
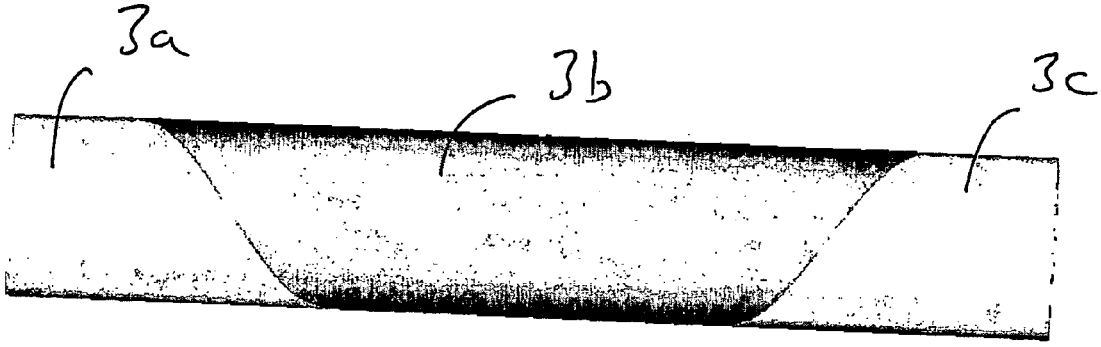
Figure 12:
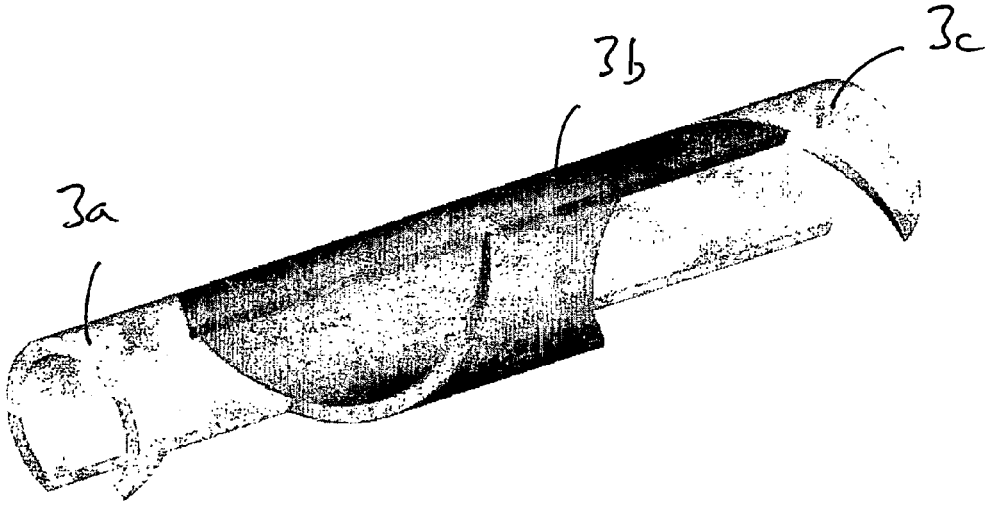
Figure 13:
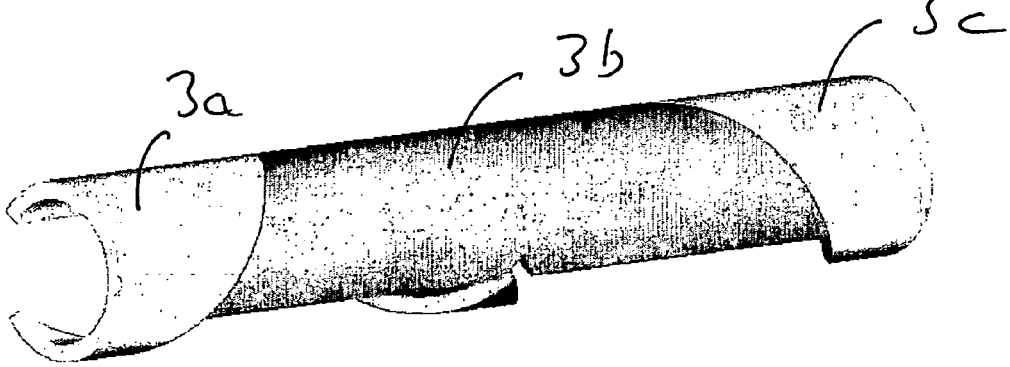

FIGS. 9 and 10 show an alternative embodiment of a means to adjust the side guides for use in an aligning device according to the present invention. These figures show schematically the outer form of an adjustable curved shell or fixed roller 3 as shown in FIG. 2. Only the outer form is shown—other details such as an inner supporting rod and a clamp or fixing means to maintain the curved shell or rod at a specific length have been omitted for the sake of clarity. The side guides 4,5 are also not shown.

The curved shell or fixed roller 3 is made up of three portions 3*a*, 3*b*, 3*c*. The outer diameter of all three portions is the same. The three portions 3*a*, 3*b*, 3*c* are used with side guides 4, 5. These guides 4, 5 may be fixed to the end portions 3*a, c* or may have separate tubular extensions like 4' and 5' in FIG. 3 which abut the ends of portions 3*a*, 3*c*. If present, the outer diameter of the tubular portions 4' and 5' of FIG. 3 is also the same as the outer diameter of the portions 3*a*-*c*. All three portions are constrained so that their central axes lie along the same line, as well as lying along the same line as the central axes of tubular portions 4' and 5' of FIG. 3, if present. The means to constrain the portions is not shown but can be, for instance, a rod on which the two outer portions 3*a, c* can move longitudinally (but not rotate) and the central portion can rotate. The position of central portion 3*b* may need to be adjustable along its length, e.g. along a support rod, to adjust the web path with respect to the printing engine. Optionally the central portion 3*b* cannot slide longitudinally, e.g. along the support rod. Suitable constraints can be provided by keys and keyways (or vice versa) in the central support rod and in the curved shells, respectively, which restrict the relevant motion.

The outer form of all the portions 3*a-c* is convex arcuate, e.g. the outer surface lies in an envelope defined by the outer surface of a cylinder. For example, a central tubular portion 3*b* can be in the form of a part of a cylinder, e.g. in the form of a curled triangle or a curled truncated triangle. The material used for all the portions may be any suitable material to act as a friction surface, e.g. it can be a plastic material. The edges of the central portion 3*b* have a helical shape. This helical form matches a similar helical form on the ends of the two tubular outer portions 3*a* and 3*c*. The edges of the central portion 3*b* are in sliding contact with the matching edges of the outer tubular portions 3*a*, 3*c*. By relative rotation of the central portion 3*b* about its own axis with respect to the outer portions 3*a*, 3*b* the outer portions are forced further apart or allowed to come together. Preferably, the central portion can move, e.g. rotate, and the outer portions remain stationary, i.e. do not rotate.

FIG. 9 shows the curved shell or fixed roller 3 according to this embodiment in its minimum extension, respectively. FIG. 10 shows the same curved shell or fixed roller 3 in its most extended position. Any intermediate position can be obtained depending upon the degree of relative rotation between the central portion 3B and the outer ones 3*a*, 3*c*.

In the above embodiment three curved shells are used to make up the sliding surface for the web. However, two curved shells can also be used. In this embodiment the outer portion 3*a* is combined with the middle portion 3*b* to form a single tubular portion. Relative rotation of this combined portion with respect to the remaining portion 3*c* changes the overall length of the curved shells. A disadvantage of using two portions is that the length change is only to one side rather than equally on both sides.

The present invention is particularly useful to replace systems such as discussed in EP0864931A1 that include a web alignment control system in which variations in web alignment are detected and compensated for by lateral adjustment of the image forming system. Whereas such systems allow accommodating very slow lateral shifts in the position of the centreline of the web, such systems generally are not very efficient in compensating for rapid changes as induced by nervous active control systems. Printing systems, which such capability of adjusting the image forming system (such as by shifting the image content with respect to the writing heads) have the flexibility of adjusting the image nicely to a stable running web with reduced web-walk. Such functionality relaxes the requirement to the alignment system for absolute accuracy in adjusting the centreline of the web to the printer, and benefit maximally from a passive solution that minimizes web walk as in the current invention.

It is to be understood that although preferred embodiments, specific constructions and configurations, as well as materials, have been discussed herein for devices according to the present invention, various changes or modifications in form and detail may be made without departing from the scope and spirit of this invention.

What is claimed is:

1. A web alignment device to align a web of continuous print medium having two outer edges and originating from an upstream device to a stable lateral position with respect to a printing system for further printing on said continuous web, the printing system having a drive system downstream of the web alignment device, the alignment device comprising:

mechanical means for defining an entry position of the web, the web contacting the mechanical means in sliding or rolling, the web being supplied as a nearly tension free loop, braking means to reduce the tension-force per unit of medium width at the end of an alignment zone compared to the tension force per unit of medium width downstream as exerted by the drive system of the printing system, means defining a curved or partially curved first web movement trajectory including areas where the print medium slides in friction contact with a curved surface, the means for defining the curved or partially curved first web movement trajectory being located upstream of said braking means, the sliding zone of the curved or partially curved first web movement trajectory extending over a finite length L1 satisfying the relation $$L1>\max(50\text{ mm}, P/4)$$

where P corresponds to the width of the print medium, adjustable lateral guiding means with side guides on both side edges of the web adjustable in width to contact at either of the two outer edges or at both outer edges of said print medium, thus limiting the lateral movement dimension available for said print medium in two opposing directions, the adjustable guiding means extending over a finite second web movement trajectory of said print medium, wherein the finite second web movement trajectory with side guides on both side edges of the web extends in the upstream direction to further than said means for defining the entry position and comprises at least a part of the first trajectory where said print medium is in sliding contact with said means defining said curved or partially curved first trajectory, L2 being the length of simultaneous side-guiding and support for sliding satisfying the relationship:

$$L2>\tfrac{2}{3}*\max(50\text{ mm}, P/4).$$

2. The device of claim 1, wherein the braking means is adapted to reduce the tension-force per unit of medium width at the end of the alignment zone compared to the tension force per unit of medium width downstream as exerted by the drive system of the printing system by a factor of at least 3.

3. The device of claim 2, wherein said finite second web movement trajectory extends over a length Lguided satisfying the relationship Lguided>max (50 mm, mediumwidth/4).

4. The device of claim 1, wherein said finite second web movement trajectory extends over a length Lguided satisfying the relationship Lguided>max (50 mm, mediumwidth/4).

5. The device of claim 1, wherein the nearly tension free loop has a tension of $2\times10^{-2}$ N/m per gram per square meter of web material or less.

6. The device of claim 1, wherein said entry position defining means comprises one or more friction inducing rollers or fixed shaft that increase the paper tension in the alignment section above a minimum tension of 6 N/m.

7. The device of claim 1, wherein the means for defining the curved or partially curved first movement trajectory comprises one or more fixed rollers or curved shells that contact the web over at least part of its width and wherein at least one of these fixed rollers or fixed shells has a radius of curvature exceeding 32 mm.

8. The device of claim 1, wherein the lateral guiding means comprises adjustable parallel flanges adjustable in a lateral direction with respect to the web.

9. The device of claim 1, wherein the means for defining the curved or partially curved first movement trajectory comprises one or more curved shells or fixed rollers that contact the web over at least part of its width and wherein the lateral guiding means comprise adjustable parallel flanges adjustable in the lateral direction with respect to the web and wherein tubular extensions comprising end segments of said fixed rollers or curved shells are integrated with said adjustable flanges and are moveable with those.

10. The device of claim 1, further comprising additional flexing means that prevent wrinkles being formed in the web when in said alignment device.

11. The device of claim 1, wherein the means for defining the curved or partially curved first movement trajectory comprises a combination of at least two curved shells, relatively rotatable one to the other, whose length is determined by relative rotation between the at least two curved shells.

12. The device of claim 11, wherein an edge of one of the curved shells is in helical form and matches the form of an edge of another of the curved shells.

13. A method to align a web of continuous print medium originating from an upstream device to a stable lateral position with respect to a printing system for further printing on said continuous web, said printing system comprising a drive system, the method comprising:

guiding the print medium at a reduced tension of said print medium compared to the downstream tension imposed by a drive of the printing system, such that the print medium forms a nearly tension free loop prior to entering into sliding contact in a sliding zone along a means defining a curved or partially curved first web movement trajectory in the web travel direction, the sliding zone of the curved or partially curved first web movement trajectory extending over a finite length L1 satisfying the relation $$L1>\max(50\text{ mm}, P/4)$$

where P corresponds to the width of the print medium, centering said print medium by guiding both lateral edges in the lateral direction by adjustable lateral guiding means along a finite second web movement trajectory that comprises at least a part of the first trajectory where the print medium is in friction sliding contact with said means defining said curved or partially curved trajectory, L2 being the length of simultaneous side-guiding and support for sliding length (L2) of the second trajectory satisfying the relationship: L2>⅔*max (50 mm, P/4).

14. The method of claim 13, wherein the nearly tension free loop generates a tension of $2\times10^{-2}$ N/m per gram per square meter of web material or less.

15. The method of claim 13, wherein said adjustable lateral guiding means are adjusted to a distance W satisfying a relation compared to the print medium width P $$P-2\text{ mm}<W<P.$$

16. The method of claim 13, wherein said adjustable lateral guiding means are adjusted to a distance W satisfying a relation compared to the print medium width P $$P-1\text{ mm}<W<P.$$

17. The method of claim 13, wherein said finite second web movement trajectory extends over a length Lguided satisfying the relationship Lguided>max (50 mm, mediumwidth/4).

18. The method of claim 13, wherein braking means reduces the tension-force per unit of medium width at the end of an alignment zone compared to the tension force per unit of medium width downstream as exerted by the drive system of the printing system by a factor of at least 3.

* * * * *